US006536174B2

(12) United States Patent
Foster et al.

(10) Patent No.: US 6,536,174 B2
(45) Date of Patent: Mar. 25, 2003

(54) REINFORCED STORM SHUTTER

(76) Inventors: Michael T Foster, 611 Fifth St., Destin, FL (US) 32541; Penny E Vance, 611 Fifth St., Destin, FL (US) 32541; Robert S Huntington, 174 Cloud Dr., Defuniak Springs, FL (US) 32541

( * ) Notice: Subject to any disclaimer, the term of this patent is extended or adjusted under 35 U.S.C. 154(b) by 0 days.

(21) Appl. No.: 09/848,992

(22) Filed: May 7, 2001

(65) Prior Publication Data

US 2002/0162277 A1 Nov. 7, 2002

(51) Int. Cl.[7] ..... E06B 5/10

(52) U.S. Cl. ..... 52/473; 52/78; 52/202; 52/203; 52/730.4; 49/62; 49/463; 49/63

(58) Field of Search ..... 52/202, 78, 473, 52/730.4, 788.1

(56) References Cited

U.S. PATENT DOCUMENTS 2,587,440 A * 2/1952 Burkhart ..... 189/63
2,835,935 A * 5/1958 Housley ..... 20/58
3,022,549 A * 2/1962 Cummings ..... 137/159
3,077,643 A * 2/1963 Horner ..... 20/56.5
5,852,903 A * 12/1998 Astrizky ..... 52/202
5,907,929 A * 6/1999 Poma et al. ..... 52/78
5,957,186 A * 9/1999 Boswell ..... 160/201

* cited by examiner

*Primary Examiner*—Carl D. Friedman
*Assistant Examiner*—Basil Katcheves
(74) *Attorney, Agent, or Firm*—H. Hampton Hunter

(57) ABSTRACT

A reinforced storm shutter for protecting doors and windows of buildings from high winds of severe storms and hurricanes. The shutter is comprised of heavy-gauge components, including tubular members having a plurality of aligned, slotted openings and louvers mounted in the aligned openings. The louvers are welded to the tubular members, preferably on the inside surface of the tube, with the weld completely sealing each slotted opening. The tubular members are then welded around the entire periphery of the tube ends to the remaining frame members of the shutter to hermetically seal the tubular members and protect the welds securing the louvers from continuous weathering conditions. The tubular members are formed of mating channel members that are sealingly secured together after the louvers have been welded in place.

12 Claims, 1 Drawing Sheet

REINFORCED STORM SHUTTER

BACKGROUND OF THE INVENTION

1. Field of the Invention

This invention relates to protective coverings for windows and doors of buildings, and more particularly to reinforced storm shutters for covering and protecting exterior windows and doors of buildings from damage from high winds and objects being propelled by the high winds of severe storms, such as hurricanes and typhoons.

2. Description of the Prior Art

As population densities increase along coastal areas in warm climates that are more prone to severe storms, for example, along the southeastern and Gulf coasts of the United States, the protection of structures from storm damage is an ever-increasing problem. Stricter building codes are regularly introduced in an effort to provide needed protection. The prior art teaches many shutter constructions that attempt to provide this protection while also providing additional features such as adjustability to different size openings, economy of materials, easy installation, transparency, etc. See U.S. Pat. No. 5,787,642 dated Aug. 4, 1998; U.S. Pat. No. 5,152,116 dated Oct. 6, 1992; U.S. Pat. No. 5,477,646 dated Dec. 26, 1995; and U.S. Pat. No. 5,907,929 dated Jun. 1, 1999. While the provision of these additional features can be appealing, we have found that they can reduce the ability of the shutter to perform its intended function of protecting the window or door that it covers. None of these patents suggest the novel features of the present invention described below.

Accordingly, the purpose of the present invention is to overcome the problems displayed by the prior art by providing an extremely strong storm shutter that protects a window or door from the winds and from objects propelled by these winds of the strongest Category 5 hurricane; requires little or no maintenance; has a long, useful life; is aesthetically appealing; and permits the building occupants to see through the shutter, along with light transmission there-through into the building.

SUMMARY OF THE INVENTION

It is an object of this invention to provide an extremely strong, improved storm shutter for use in protecting window and door openings in buildings of all types and sizes during the strongest hurricanes.

It is another object of this invention to provide an improved storm shutter having tubular framing members that are hermetically sealed, thereby increasing the useful life of the shutter.

It is a further object of this invention to provide an improved storm shutter that, When in use, permits the building occupants to see through the shutter and allows transmission of light as well as air, if desired, into the building.

These and other objects of the invention are achieved by providing an extremely strong shutter assembly that includes hermetically sealed tubular frame members, secured together at their respective ends and extending around the periphery of the shutter to form the outer frame of the shutter. A centrally-positioned reinforcing tubular frame member is included, and is secured at the ends thereof to the adjacent upper and lower outer frame members. The outer frame side members and the centrally-positioned frame member have a plurality of rows of horizontally-aligned slots in their facing walls that extend the full length of the central and side members. A louver, or flatbar, is carried by each row of horizontally-aligned slots, and is secured to each of the central and side members.

Further objects and advantages of the present invention will become more readily apparent from the following detailed description of the preferred embodiment, which is set forth for the purpose of providing a full disclosure of the invention without limiting in any way its scope.

DETAILED DESCRIPTION OF THE PREFERRED EMBODIMENT

Figure 1:
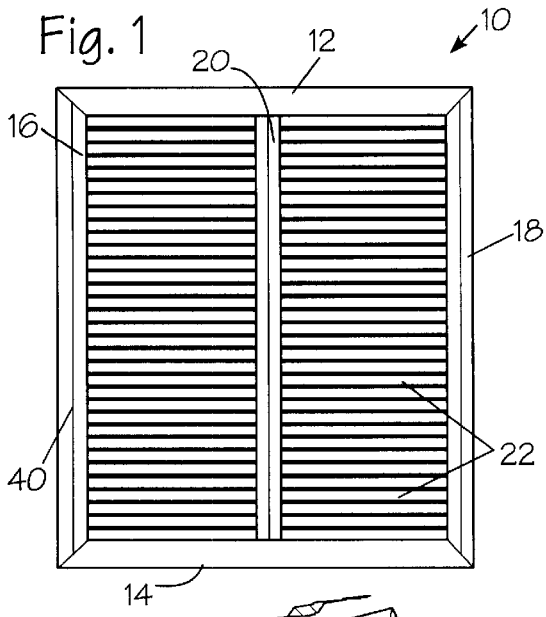
FIG. 1 is a front view of the storm shutter of this invention in use.

While the instant invention is susceptible of embodiment in many different forms, there is shown in the drawing, and will be described herein in detail, a specific embodiment thereof, with the understanding that the present disclosure is to be considered as an exemplification of the principles of the invention and is not intended to limit the invention to the specific embodiment illustrated.

Figure 2:
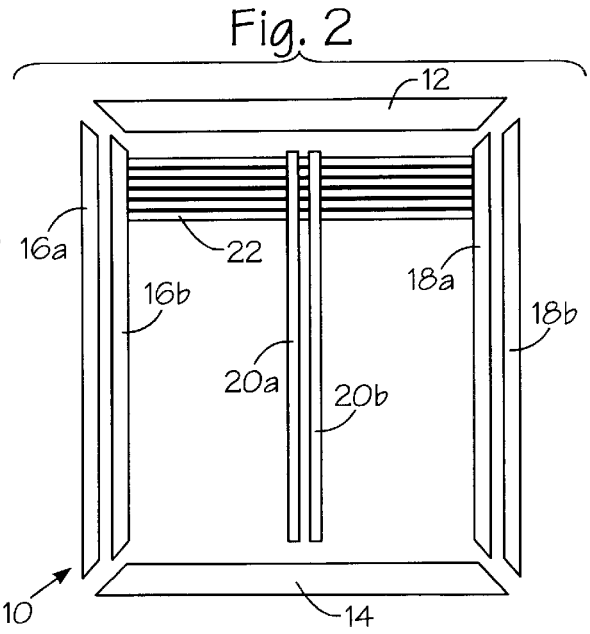
FIG. 2 is an exploded view of the frame of the shutter, having some of the flatbars included.

As shown in FIGS. 1 and 2, the storm shutter assembly, as generally referred to by the numeral 10, is made of a plurality of members with improved features enabling the same to be assembled in a unique and inventive manner.

Figure 4:
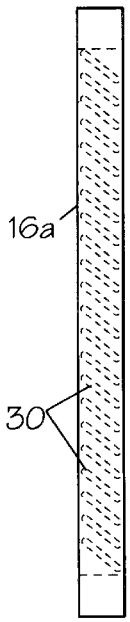
FIG. 4 a left side view of the shutter as illustrated in FIG. 1.
Figure 5:
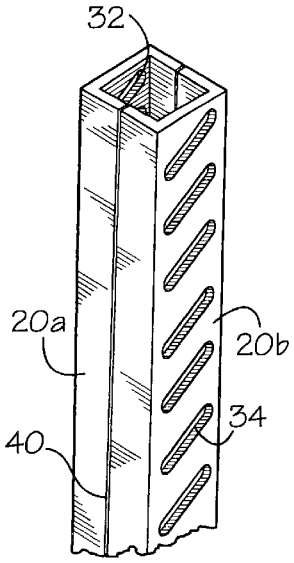
FIG. 5 is an enlarged-perspective, broken-away partial view of the centrally-positioned frame member.

More specifically, the storm shutter of the present invention, as viewed in FIG. 1, includes top, bottom, left side and right side rigid tubular members 12, 14, 16 and 18, respectively, forming a rigid outside support frame of the shutter assembly. Thus, the outside frame structure provides a support frame for a storm shutter assembly that is hermetically sealed, as set forth in detail below. The storm shutter assembly can include a third rigid tubular support member 20, if needed, that is centrally-positioned between said side members 16, 18, and secured to top and bottom members 12, 14, providing additional support for said shutter assembly. Each of the side support members 16 and 18, and the central support member 20 is comprised of mating channel members 16*a*, 16*b*, 18*a*, 18*b* and 20*a*, 20*b*, as best illustrated in FIGS. 2 and 5. The outside mating channel members 16*a*, 18*b*, see FIG. 2, are imperforate throughout their length, whereas the inside, inwardly-facing mating channel members 16*b*, 18*a* have equally-spaced slotted openings 30, see FIG. 4, along the length thereof to hold the louvers or flatbars 22. The openings 30 are laterally aligned and extend at approximately an angle of 45°; however, any desired angle can be employed. The central support mating members 20*a*, 20*b* are also provided with equally-spaced slotted openings 32, 34, see FIG. 5, extending at the same angle as the openings 30 and laterally aligned therewith to carry a flatbar 22. It a should be noted in FIG. 2 that the ends of the top, bottom and side members are cut on an angel of 45° to assure easy assembly of the outer support frame, while the central support member is square-cut for easy securement to the top and bottom members.

Figure 6:
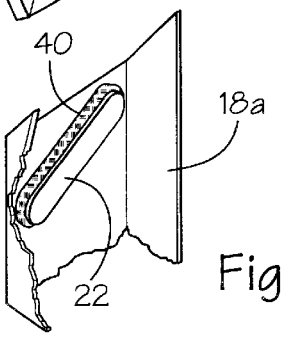
FIG. 6 is an enlarged-perspective, broken-away view of the top portion of the inner part of the right side frame member as viewed in FIG. 2.

Assembly of the shutter is an important part of the invention, as will be obvious from the following. The flatbars 22 are secured approximately at their mid-point to either one of the mating channel members 20*a*, 20*b* of the central support 20. The securement of these two members is accomplished by welding the flatbar 22 around its entire periphery to the inside surface of the channel member, see 40 in FIG. 6, thereby sealing the opening 32 or 34 of the selected channel member and providing a very strong connection between the two members. When all the flatbars 22 have been welded as above to the selected channel member, the remaining channel member of the central support 20 is positioned on the flatbars and moved into mating position with the selected channel member and welded thereto along the front and back sides as shown at 40 in FIG. 5 to form the tubular central support 20. Thus, all the welds on the flatbar 22 are internal of the central support tube 20, thereby precluding overt engagement with continuous deteriorating weather conditions, while at the same time improving the aesthetics of the shutter. The inwardly-facing channel members 16*b*, 18*a* of the side members 16, 18 are also welded to the flatbars 22 along their inner surfaces in the same manner as the central support member 20.

Upon completion of welding all flatbars 22 to the inside surfaces of the channel members 16*b*, 18*a*, the mating outer channel members 16*a*, 18*b* are welded to the respective inner channel members along the mating front and back sides thereof to form closed tubes along their length that include openings only at the ends. Upon completion of welding of the mating channel members of the side members 16, 18 and the central member 20, tubular members have the same cross-sectional dimension as the top and bottom members 12, 14, thus assuring mating surfaces at each corner. The top and bottom members 12, 14 are then welded to the side members 16, 18 at the corners. These welds also extend entirely around the peripheries of the corners, thereby forming a hermetically-sealed outer frame for the shutter. While all the welds securing the flatbars 22 are internal of the tubular side members 16, 18 and the tubular central member 20, the welds 40 securing the channel members together to form these tubular members are exterior welds; however, these exterior welds are ground and/or polished to present a substantially planar surface at least on the visible surfaces, thereby providing an aesthetically pleasing shutter that is exceptionally strong mechanically. It should be noted that the welding of each louver or flatbar 22 at three distinct locations dramatically increases the strength of our shutter. Also, while the top and bottom frame members 12, 14 have been disclosed as being tubular, these two members can be of solid stock, if so desired, with only the two sides being sealed hollow tubes to protect the flatbar welds and still meet the objects of the invention.

Figure 3:
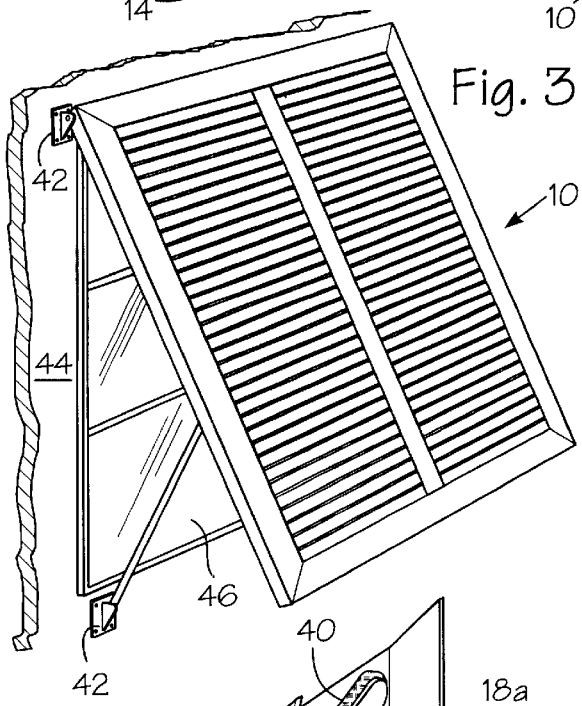
FIG. 3 is a perspective view of the shutter in use over a window.

With particular reference to FIG. 3, the shutter 10 of this invention is shown mounted by hinges 42 on a wall segment 44 and protecting a window 46. As illustrated, the shutter 10 is mounted to swing on a horizontal axis; however, it is clear that the shutter can be mounted to swing on a vertical axis or in any direction that is preferred.

From the foregoing, it will be observed by one of ordinary skill in the art that numerous variations and modifications may be effected without departing from the scope of the referred embodiment described hereinabove and the true spirit and scope of the novel concept of the invention. As an example, while we prefer the employment of aluminum materials and welding, it is quite obvious that other metals and/or synthetic or plastic materials or welds could be employed by one of ordinary skill in the art to achieve a similar result. Similarly, it is clear that the tubular support members can take any preferred configuration. Also, as discussed above, for the purposes of this invention it is not required that the outer frame be hermetically-sealed around its entire periphery, but rather only the two side members 16, 18 be hermetically-sealed for protection of the internal welds therein. Accordingly, it should be quite clear that the description supra is intended to be illustrative only and in no way limiting to the scope of the appended claims.

What is claimed is:

1. A storm shutter assembly for protecting windows, doors and the like of a building during severe weather storms comprising:

A hermetically-sealed outer frame forming an enclosed opening permitting unencumbered air flow therethrough during both normal and severe weather conditions; said outer frame including:

Spaced rigid top and bottom members;

Spaced rigid tubular side members, one end of each tubular side member being configured to mate with and sealingly-secured around its entire tubular periphery to the mating periphery of the top member and the other end of each tubular side member being configured to mate with and sealingly-secured around its entire tubular periphery to the mating periphery of the bottom member; and A plurality of spaced flatbars in said enclosed opening extending between said side members and in substantial alignment with each other, each end of said flatbars being rigidly secured to one of said side members;

Whereby a strong shutter assembly is provided.

2. A storm shutter assembly as claimed in claim 1, wherein each of said tubular side members is divided along its length into an outer part and a mating, inner part facing the inner part of the other side member, said inner part of each of said side members having equally-spaced, slotted openings along the length thereof, the slotted openings in one inner part being laterally-aligned with the slotted openings in the inner part of the other side member, the ends of each flatbar extending through a pair of said aligned slotted openings, the securing means for said flatbars securing said flatbars to the inside surface of each of said inner parts, and means securing each of said outer tubular parts to its mating inner tubular part, said securing means for said flatbars and for said mating tubular parts being sealingly-secured to each other around the periphery thereof, whereby the securing means for said flatbars are protected from overt engagement with continuous deteriorating weather conditions.

3. A storm shutter assembly as claimed in claim 2, further including a third rigid support means for said flatbars centrally positioned in said enclosed opening, the ends of said support means being rigidly secured to said top and bottom tubular members, and each of said flatbars being rigidly secured to said third support means.

4. A storm shutter assembly as claimed in claim 3, wherein said third rigid support means for said flatbars is a tubular member divided along its length into separate mating parts, each mating part having equally-spaced, slotted openings along the length thereof, said openings in each part being laterally-aligned with each other and with a laterally-spaced opening in the inner part of each said side member when the parts are assembled together, each of said flatbars extending through a pair of aligned slots and the securement of the flatbars to the third support is located on the inside of a first one of said mating parts, and the other of said mating parts being secured to the first mating part.

5. A storm shutter assembly as claimed in claim 4, wherein said shutter assembly is constructed with metal components and the means of securing the components is a weld.

6. A storm shutter assembly as claimed in claim 5, wherein the metal employed is aluminum.

7. A storm shutter assembly as claimed in claim 5, wherein said top, bottom and side members are rectangular and the mating ends of the outer frame members extend at 45 degrees.

8. A storm shutter assembly as claimed in claim 1, further including means for securing said shutter assembly to a building.

9. A storm shutter assembly for protecting windows, doors and the like of a building during severe weather storms comprising:

a rigid outer frame forming an enclosed opening including:

spaced rigid top and bottom members;

spaced rigid tubular side members, each side member being divided along its length into an outer part and a mating inner part facing the inner part of the other side member, each of said inner parts of said side members having spaced, slotted openings along the length thereof, the respective openings in one inner part being laterally-aligned with the openings in the other inner part thereby providing laterally-aligned pairs of openings;

a plurality of aligned, rigid flatbars extending between said side members, each one of said flatbars being positioned to extend through each of said openings in one of said aligned pairs;

means sealingly securing the ends of each of said flatbars to the inner surface of each of said inner parts around said openings thereby sealing each opening; means sealingly securing together the mating inner and outer parts of said tubular side members along the length thereof; and means sealingly securing the ends of said top and bottom rigid members to the adjacent mating ends of said rigid tubular side members;

whereby said tubular side members are hermetically sealed and said securing means for said flatbars are protected from direct engagement with deteriorating weather conditions.

10. A storm shutter assembly as claimed in claim 9, wherein the means securing the ends of the flatbars, the means securing together the inner and outer parts of the tubular side members and the means securing the ends of the top, bottom and side members completely seal the adjacent surfaces, thereby hermetically sealing said tubular members.

11. A storm shutter assembly as claimed in claim 1 wherein the top and bottom members are tubular.

12. A storm shutter assembly as claimed in claim 9, wherein the top and bottom members are tubular.

* * * * *